United States Patent [19]

Klavitter

[11] 4,143,808

[45] Mar. 13, 1979

[54] TYPEWRITER WORD COUNTER

[76] Inventor: George Klavitter, 30233 Rosebriar, St. Clair Shores, Mich. 48082

[21] Appl. No.: 822,526

[22] Filed: Aug. 8, 1977

[51] Int. Cl.[2] ..... B41J 29/24

[52] U.S. Cl. ..... 235/102; 400/705.2

[58] Field of Search ..... 197/180, 187; 235/102; 400/703, 705.2

[56] References Cited

U.S. PATENT DOCUMENTS

| | | | |
|---|---|---|---|
| 524,496 | 8/1894 | Withrow | 235/102 |
| 586,730 | 7/1897 | Menck | 235/102 |
| 954,277 | 4/1910 | Girand | 235/102 |
| 988,037 | 3/1911 | Sharp et al. | 235/102 |
| 1,617,774 | 2/1927 | Smith | 235/102 X |
| 3,039,435 | 6/1962 | Meyer | 197/181 X |

FOREIGN PATENT DOCUMENTS

| | | | |
|---|---|---|---|
| 1038266 | 9/1953 | France | 197/187 |

*Primary Examiner*—Paul T. Sewell

[57] ABSTRACT

A typewriter word counter which has a support, magnetic apparatus that removably positions the support on the typewriter to be used, a push button counter carried by the support, and a lever that has one end pivotally connected to the support, an intermediate portion supported by the push button of the counter and another end portion that is positionable below the space bar of a typewriter such that each time the space bar is depressed, after a word is typed, the lever is moved downward to push the button and actuate the counter to register a word count on a digital readout visible to the typist, and when the space bar is released, the push button returns the lever to its initial rest position where it is again ready to push the button to indicate another word when the space bar is depressed.

3 Claims, 2 Drawing Figures

TYPEWRITER WORD COUNTER

BACKGROUND OF THE INVENTION

1. Field of the Invention

This invention relates generally to counter apparatus, and more particularly to a typewriter word counter.

2. Description of the Prior Art

Prior word counters for typewriters were complex, involving numerous parts which made manufacture and maintenance difficult and expensive. One other disadvantage of prior devices was that no provision was made for quick, simple, removable attachment of the word counter to different typewriters without need for modification.

Examples of prior art devices are found in U.S. Pat. Nos: 1,710,777; 2,297,180; 1,749,079; 1,798,707; 1,842,671; 2,265,088; 2,421,683; 2,435,450; and 3,845,900.

SUMMARY OF THE INVENTION

Accordingly, one object of the present invention is to provide typewriter word counter apparatus which counts a word each time the typewriter space bar is depressed.

Another object is the provision of word counter apparatus that can be easily removably attached to different typewriters without the need for modification of the typewriters.

A further object is to provide typewriter word counter apparatus which is simple in construction, inexpensive, and easy to operate.

These and other objects and advantages will become more apparent during the course of the following description.

DESCRIPTION OF THE PREFERRED EMBODIMENT

Figure 1:
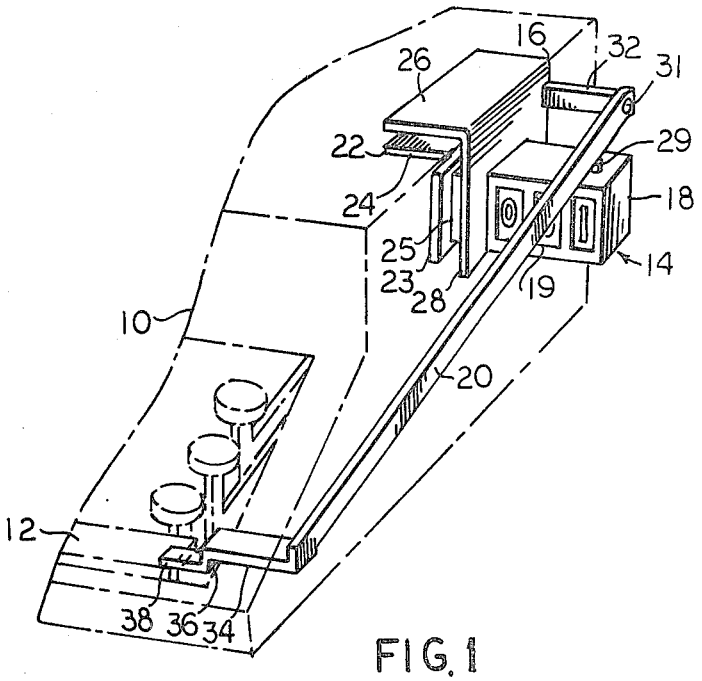
FIG. 1 is a fragmentary perspective view of a typewriter incorporating the word counter of the present invention.
Figure 2:
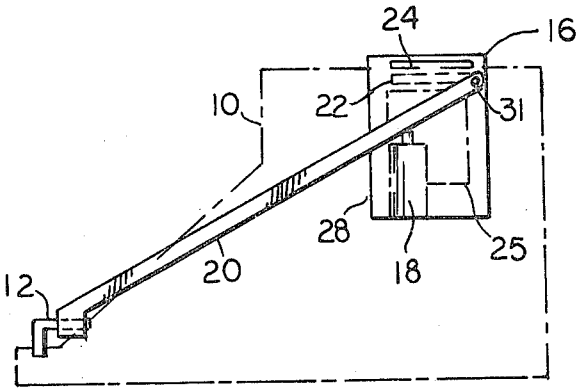
FIG. 2 is a side elevational view of the typewriter and word counter of FIG. 1.

Referring now to the drawings there is illustrated in FIGS. 1 and 2, a conventional typewriter 10 having a space bar 12. The numeral 14 generally designates the word counter apparatus of the present invention which consists of a support 16, counter 18, lever 20, plates 22, 23 and magnets 24, 25. Support 16 is a right angled plate member fashioned from a metal such as steel, or the like, and has portions 26 and 28.

Counter 18 is a conventional digital counter and is permanently secured to portion 28 of the support 16, as by welding or the like. Counter 18 is of the type that is capable of registering a series of events and is provided with a push button 29 such that when pushed it actuates the counter to record a single event and then returns to its initial position and remains there until pushed again to cause the counter to record another event. It will be apparent that a series of events can thus be recorded by counter 18 simply by pushing button 29 each time an event occurs. The total number of events is indicated by a digital read-out such as that illustrated and designated by the numeral 19.

Lever 20 has one end portion pivoted by means of a fulcrum pin 31 carried by a post 32 secured to the portion 28 of support 16 for rotation about a substantially horizontal axis. The intermediate portion of lever 20 rests on push button 29. The other end of lever 20 is formed into a substantially horizontal extending section 34, a substantially vertical downward extending intermediate section 36, and another substantially horizontal extending section 38.

Metal plates 22, 23 and magnets 24, 25 serve to removably position word counter 14 on the plastic casing of typewriter 10. Metal plate 22 is suitably attached as by an adhesive to the inner surface of the typewriter casing top wall, and plate 23 is similarly secured to the inner surface of an adjacent casing side wall. Magnets 24, 25 are permanently attached as by welding, to support portions 26, and 28 respectively.

In operation, each time space bar 12 is depressed after a word is typed on typewriter 10, it engages section 38 of lever 20 and rotates the lever in a downward direction about the horizontal axis of pivot 31. Rotation of lever 20 in the downward direction pushes in button 29 which activates counter 18 to register a single word count on read-out 19. When space bar 12 is released, force is removed from section 38 and push button 29 is free to rotate lever 20 back up to its initial rest position where it remains until space bar 12 is depressed again to activate button 29 to provide indication of yet another word on read-out 19 of counter 18.

The above description of the presently preferred embodiment of the invention will suggest various changes, substitutions, and other departures from the disclosure within the spirit and scope of the appended claims. One such change could be accomplished by mounting the counter 18 and pivoting lever 20 on a block of sufficiently heavy wood or metal instead of the support 16 whereby the counter apparatus could be then positioned adjacent the typewriter 10 without falling over when space bar 10 is depressed. Another departure may involve simply pivotally mounting the lever 20 directly on a sufficiently heavy counter 18.

What I claim is:

1. Word counter apparatus for a typewriter having a space bar and casing with a top wall and an adjacent side wall comprising:

a support;

a push button counter secured to said support;

a lever having one end portion pivotally connected to said support for movement about a substantially horizontal axis, an intermediate portion supported by the counter push button, and another end portion having a first substantially horizontal section, a substantially vertical intermediate section, and a second substantially horizontal end section; and magnet means for magnetically detachedly positioning said support on the outer surfaces of the casing top and adjacent side walls to position said end section below the space bar for engagement and movement with the space bar when the space bar is depressed.

2. The word counter apparatus of claim 1 wherein said magnet means comprises:

metal plates positionable on the casing top and adjacent side wall inner surfaces; and magnets carried by said support and positionable on the casing top and adjacent side wall outer surfaces opposite said metal plates.

3. Word counter apparatus for a typewriter having a space bar and a casing with a top wall and an adjacent side wall comprising:

a plate member having first and second angled portions positionable on the typewriter top and side wall outer surfaces, respectively;

a push button counter secured to said second plate member portion;

a lever having one end portion pivotally connected to said second plate member portion for movement about a substantially horizontal axis, an intermediate portion supported on the counter push button, and another end portion having a first substantially horizontal section a substantially vertical intermediate section, and a second substantially horizontal end section;

a pair of metal plates attachable with adhesive material to the top and side wall inner surfaces, respectively; and a pair of magnetic members each of said magnetic members being secured to one of said plate member portions for detachedly positioning said plate member on the typewriter casing opposite said metal plates and said end section below the space bar for engagement and movement with the space bar when the space bar is depressed to actuate the counter.

* * * * *